US005661930A

United States Patent [19]

Porter

[11] Patent Number: 5,661,930

[45] Date of Patent: Sep. 2, 1997

[54] HOUSE FLOOR SYSTEM AND SHIPPING CONTAINER THEREFOR

[76] Inventor: William H. Porter, P.O. Box 249, Saugatuck, Mich. 49453

[21] Appl. No.: 604,734

[22] Filed: Feb. 21, 1996

[51] Int. Cl.[6] ..... B65D 88/52

[52] U.S. Cl. ..... 52/64; 52/70; 52/71; 52/125.2; 52/309.7; 52/309.9; 52/309.14; 52/479; 52/483.1; 52/794.1; 52/801.1; 220/1.5; 220/4.28; 220/6

[58] Field of Search ..... 52/64, 71, 70, 52/125.2, 309.7, 309.9, 309.14, 479, 483.1, 794.1, 801.1; 220/1.5, 4.28, 6

[56] References Cited

U.S. PATENT DOCUMENTS

| | | | |
|---|---|---|---|
| 2,670,986 | 3/1954 | Presnell | 52/71 |
| 3,434,253 | 3/1969 | Hatcher | 52/70 |
| 3,814,220 | 6/1974 | Brody | 220/6 X |
| 4,214,669 | 7/1980 | McQuiston | 220/6 |
| 4,425,741 | 1/1984 | Ronai | 52/70 |
| 4,998,637 | 3/1991 | Marovskis | 220/6 |
| 5,119,935 | 6/1992 | Stump et al. | 220/6 X |
| 5,279,436 | 1/1994 | Elliott et al. | 52/801.1 X |
| 5,351,915 | 10/1994 | Aandalen | 52/483.1 X |
| 5,493,817 | 2/1996 | Speer | 220/1.5 X |

*Primary Examiner*—Christopher Todd Kent
*Attorney, Agent, or Firm*—Emrich & Dithmar

[57] ABSTRACT

Plural flat sections hingedly coupled together from the floor of a building structure such as a house when arranged in an unfolded, flat configuration and form a generally closed container when arranged in a folded configuration. With the floor sections in the folded configuration, the thus formed container is adapted to receive and enclose other building structures and serves as a shipping container for the entire building. Removable metal joining members are attached to adjacent corners of the floor sections and are disposed in the corners of the rectangular container when the floor sections are folded. The metal joining members each include a reinforcing angle to strengthen the container and a conventional coupling bracket to facilitate handling of the container during shipping, permitting the container to be handled as a standard shipping container. Each floor section includes a structural insulated panel with metal edges, with a standard floor panel being 20 feet long by 8 feet wide, but may be as long as 40 feet. The folded floor container may be used to store other building components, such as walls, roofs, etc., during shipping, thus substantially reducing the shipping volume as compared to a pre-assembled building and eliminating the need to fabricate and return a separate shipping container.

12 Claims, 4 Drawing Sheets

HOUSE FLOOR SYSTEM AND SHIPPING CONTAINER THEREFOR

FIELD OF THE INVENTION

This invention relates generally to building structures and is particularly directed to a self-containerized building structure, when folded for shipping, which can be unfolded for assembly following shipping.

BACKGROUND OF THE INVENTION

Building structures are increasingly being fabricated at a manufacturing plant at a first location for shipment to a second location, where the structure is assembled onsite. Major structural units are assembled at the manufacturing plant and attached to adjacent sections of the structure onsite. This approach reduces the cost of construction, increases the quality of the final product, and expedites assembly of the structure. This is particularly true in the case of low cost housing which is increasingly being shipped from more industrialized countries, to countries having a less developed economy to make comfortable housing available for more people of the world.

Houses manufactured and assembled in this manner are typically shipped in a closed container. The container must be of a considerable size and strength to enclose and protect the various house structural components and assemblies. The size and strength of such containers requires that they be reusable, thus requiring the container to be returned to the site of manufacture of the house. This procedure is expensive and cumbersome, particularly when the house is shipped to and assembled in a remote location in a sparsely populated and less economically developed country. The large size of a container required to ship a house or similar building necessitates considerable storage space during transport thus increasing the cost of this approach to housing manufacture and construction.

The present invention addresses the aforementioned limitations of the prior art by providing a self-containerized building structure, wherein the container itself is formed from the structure's multi-section floor which forms a substantially closed container when folded for receiving and enclosing the remaining portions of the building structure.

OBJECTS AND SUMMARY OF THE INVENTION

Accordingly, it is an object of the present invention to provide a self-containerized building structure which can be folded to form a compact shipping container and unfolded for assembly.

It is another object of the present invention to provide a building structure including a plurality of hingedly coupled flooring sections which may be folded to form a substantially closed, compact, high strength and rigid structure for enclosing various building structure components, such as walls, roofs, etc., for shipping, and when unfolded forms the floor of the building structure permitting the other building structure components to be removed and assembled.

Yet another object of the present invention is to eliminate the need for a separate shipping container for shipping a building structure and various building structure components by providing a self-containerized building structure which can be moved by conventional container handling equipment.

This invention contemplates a building floor system and shipping container therefor comprising: a plurality of rectangular, generally flat floor sections each having a peripheral metal edge portion and floor decking attached to the metal edge portion; hinges for pivotally coupling each floor section to one or more adjacent floor sections, wherein the floor sections may be folded to form a substantially closed container for enclosing other building structural members such as for shipping or wherein the floor sections may be unfolded to form a generally flat structure for use as a floor; and reinforcing members attached to adjacent corners of the metal edges of coupled floor sections when the floor sections are folded for increased strength of the closed container, wherein the reinforcing members may be removed to permit the floor sections to be unfolded to form the generally flat floor structure.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
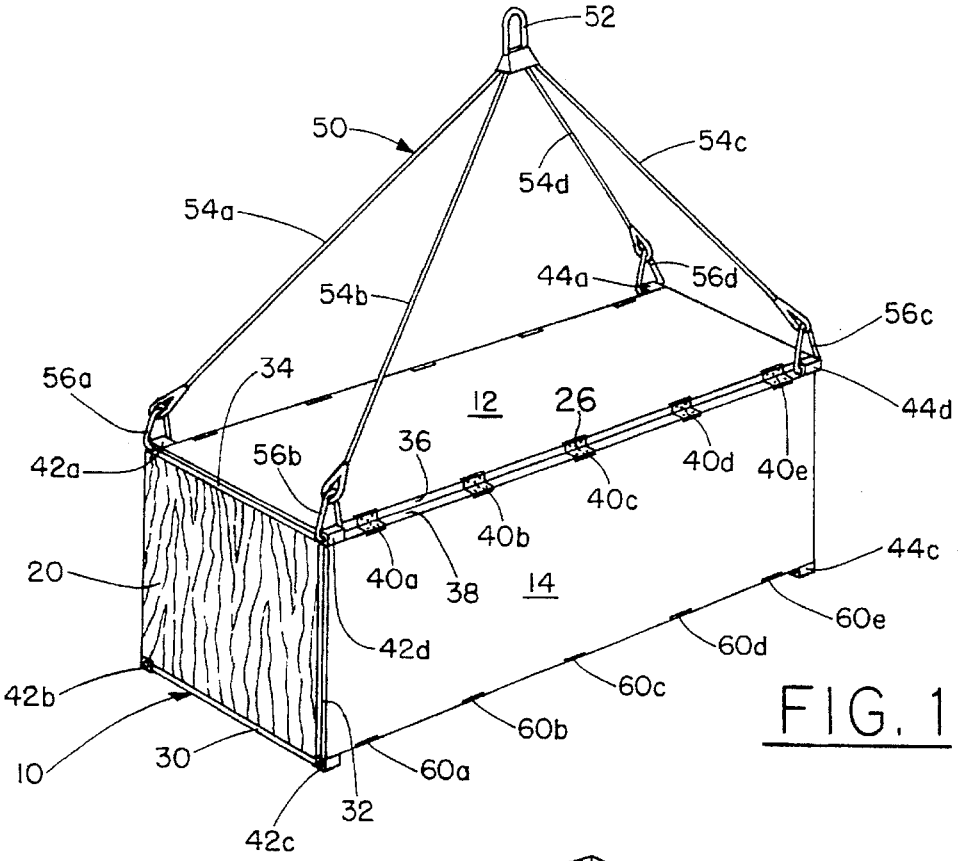
FIG. 1 is a perspective view of a floor system shown in the folded configuration so as to form a closed shipping container in accordance with one aspect of the present invention.
Figure 2:
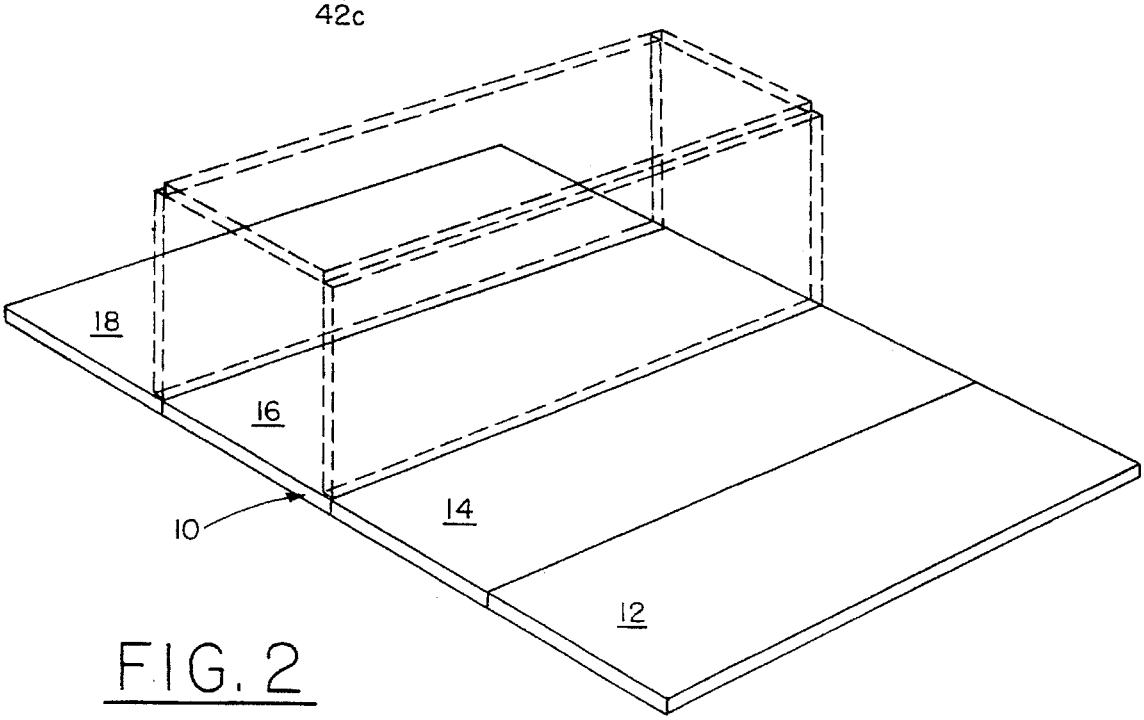
FIG. 2 is a perspective view of the floor system of the present invention showing the floor sections in the unfolded, or extended, configuration in solid line form and in the folded configuration in dotted line form.
Figure 3:
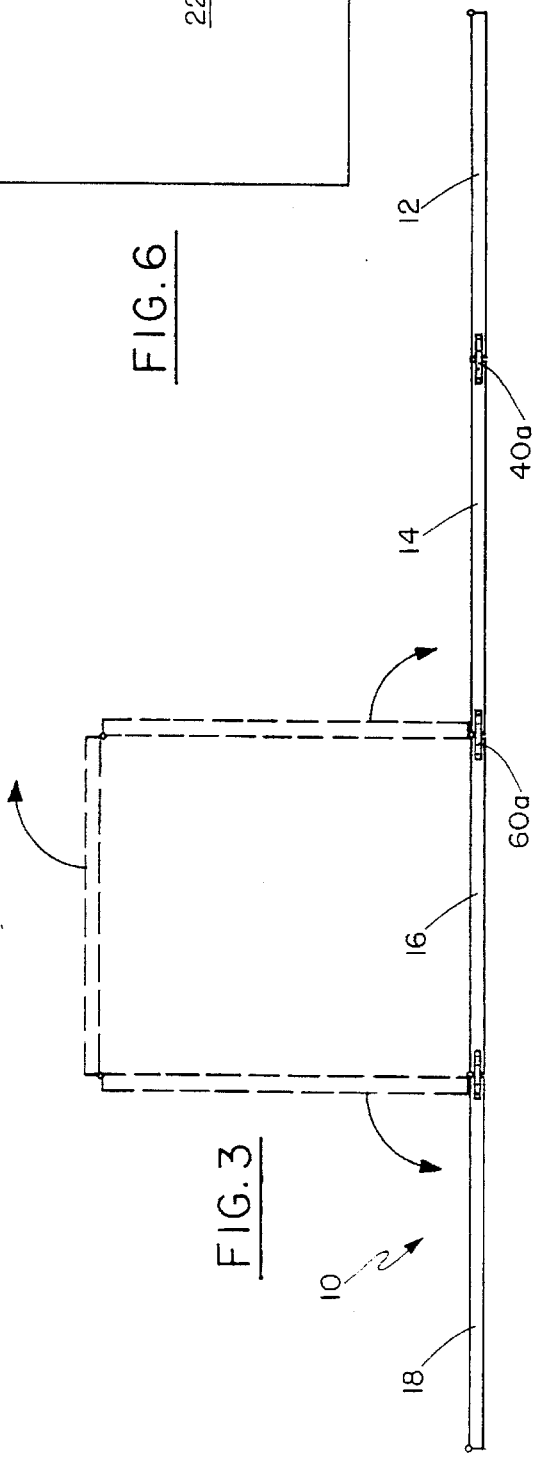
FIG. 3 is an end-on view of the floor system of FIG. 2.
Figure 5:
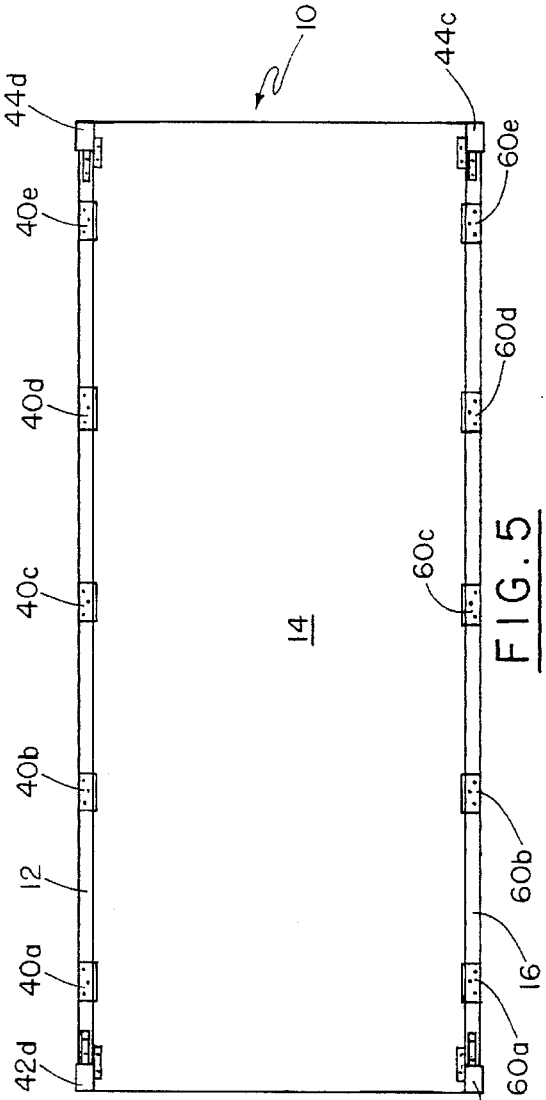
FIG. 5 is a side elevation view of the folded floor system arrangement of FIG. 1 shown in the form of a closed container.
Figure 4:
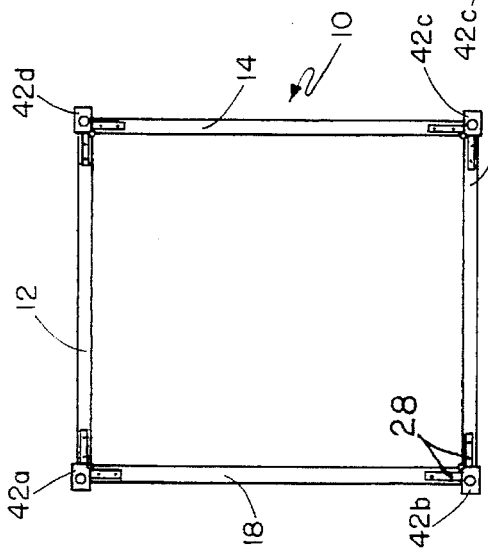
FIG. 4 is an end-on view of the folded floor system of FIG. 1 with the end panel removed.

Referring to FIG. 1, there is shown a perspective view of a house floor system 10 shown in the folded configuration so as to form a closed shipping container in accordance with one aspect of the present invention. While reference is made herein to a house and a house floor system, the present invention is equally applicable to virtually any type of building structure and its floor system. The house floor system 10 as shown in the unfolded configuration in FIG. 2, where the first, second, third and fourth floor sections 12, 14, 16 and 18 are arranged in a generally planar configuration. The house floor system 10 is shown in dotted line form in the aforementioned folded configuration in FIG. 2. FIGS. 3 and 4 show end-on views of the house floor system in the unfolded and folded configuration, respectively. Finally, FIG. 5 is a side elevation view of the house floor system 10 in the folded configuration forming a shipping container as described below.

The inventive house floor system 10 included the aforementioned first, second, third and fourth planar floor sections 12, 14, 16 and 18. Each of the floor sections includes a plurality of metal edges disposed about the periphery thereof and a wooden panel suitable for floor decking. Thus, with reference to FIG. 1, floor section 12 includes a pair of opposing end metal edges, one of which is shown as element 34, and opposed side metal edges, one of which is shown as element 36. Similarly, floor section 14 includes opposed end metal edges, one of which is shown as element 32, and opposed side metal edges, one of which is shown in the figure as element 38. Each floor section is coupled to at least one adjacent floor section by means of a plurality of spaced hinges attached to adjacent metal edges of the panels. Thus, first and second floor sections 12, 14 are pivotally coupled together by means of a plurality of hinges 40*a*–40*e*. Similarly, second and third floor sections 14, 16 are pivotally coupled together by means of a plurality of spaced hinges 60*a*–60*e*.

As shown for the case of hinge 40*c* connecting the first and second floor sections 12, 14, each of the hinges is securely attached to adjacent sections by means of a plurality of screws or bolts 26.

The house floor system 10 is shown in FIG. 1 during shipping as coupled to and supported by a lift/hoist mechanism system 50 which includes an upper ring/hook 52 and a plurality of support wires 54*a*–54*d*. Attached to a lower end of each of the support wires 54*a*–54*d* is a respective lower ring/hook, or shackle, shown as elements 56*a*–56*d* in FIG. 1. Each of the lower rings/hooks 56*a*–56*d* is adapted for connection to a conventional International Standards Organization (ISO) corner joining device as described below.

Figure 6:
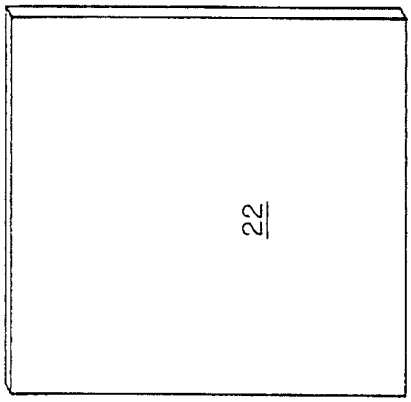
FIG. 6 is a perspective view of an end panel for use in the shipping container configuration of the present invention.

Disposed on each end of the house floor system 10 in the folded configuration as show in FIG. 1 are respective end panels, with one end panel identified as element 20 in the figure. A perspective view of end panel 20, which is preferably also comprised of wood, is shown in FIG. 6. Each end panel is adapted for attachment to the metal edges of four adjacent floor sections by conventional means such as by engagement with the metal edges or by means of screws or bolts. The four floor sections in the folded configuration together with the pair of end panels form the house floor system 10 when folded into a closed, secure container.

Disposed at the four corners of a first end of the house floor system 10 when folded are four corner connectors, or fittings, 42*a*–42*d*. Similarly, disposed at the four corners of the opposed end of the house floor system 10 are four corner connectors, or fittings, three of which are shown in FIG.1 as elements 44*a*, 44*c* and 44*d*.

Figure 7:
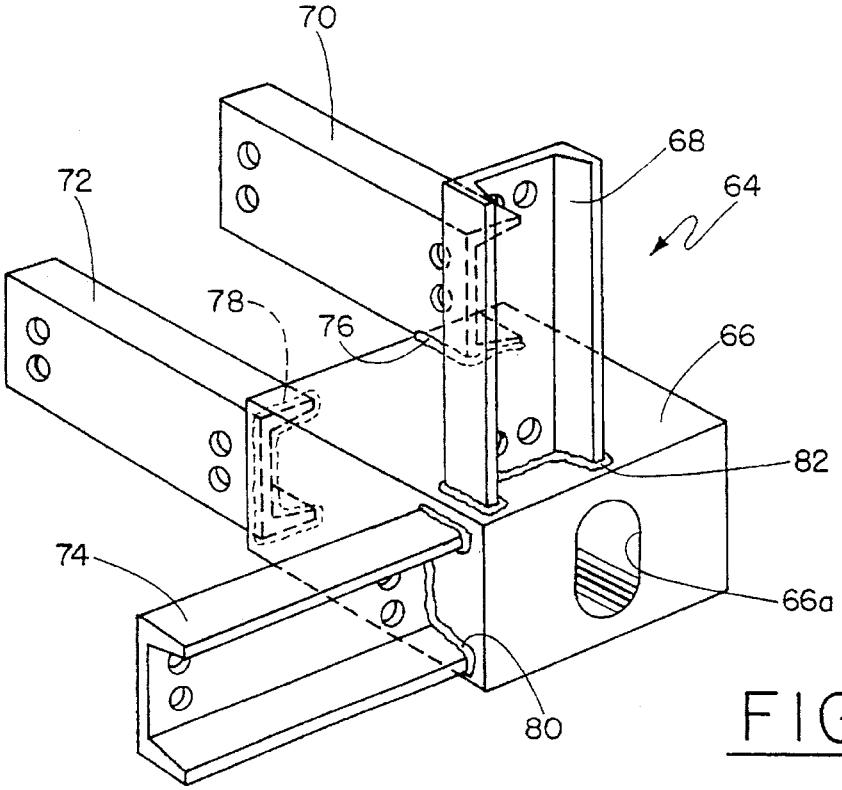
FIG. 7 is a perspective view shown partially in phantom of a corner fitting for use in the closed container configuration of the present invention.

Referring to FIG. 7, there is shown a perspective view of a corner connector 64 disposed in each of the eight corners of the house floor system when folded as described above. The corner connectors provide a high degree of strength and rigidity for the house floor system 10 when folded and permit the enclosure to be handled by conventional material handling equipment to facilitate its transport and storage. Corner connector 64 includes a generally rectangular, closed standard ISO casting 66 having at least one generally oval aperture 66*a* therein which is adapted to receive an engaging and lifting bar which is not shown in the figure for simplicity. The standard ISO castings 66 permit the house floor system of the present invention to be shipped as a standard ISO shipping container. These castings have standard holes for accepting locking devices for handling and shipping on rail cars, cranes and ocean going vessels. A plurality of C-shaped channels are attached to various outer surfaces of casting 66 by conventional means. Thus, first, second, third and fourth channels 68, 70, 72 and 74 are securely attached to various outer surfaces of casting 66 by weldments 82, 76, 78 and 80, respectively. Each of the aforementioned C-shaped channels has a plurality of spaced apertures for attaching the corner connector 64 to the metal edges of two adjacent floor sections when the house floor system is in the folded configuration. For example, as shown for the case of corner connector 42*b* in FIG. 4, each of the corner connectors is securely attached to adjacent sections by means of a plurality of screws or bolts 28. By connecting each of the C-shaped channels to a metal edge of an adjacent floor section, the structural strength of the house floor system when in the folded configuration is greatly enhanced. Each of the corner connectors is removable from the folded house floor system to permit the house floor system to be unfolded so as to assume the generally planar configuration shown in FIGS. 2 and 3. The arrows in FIG. 3 indicate the direction of pivoting displacement of the first, second and fourth floor sections 12, 14 and 18 relative to the third floor section 16 as the house floor system 10 is unfolded.

Figure 8:
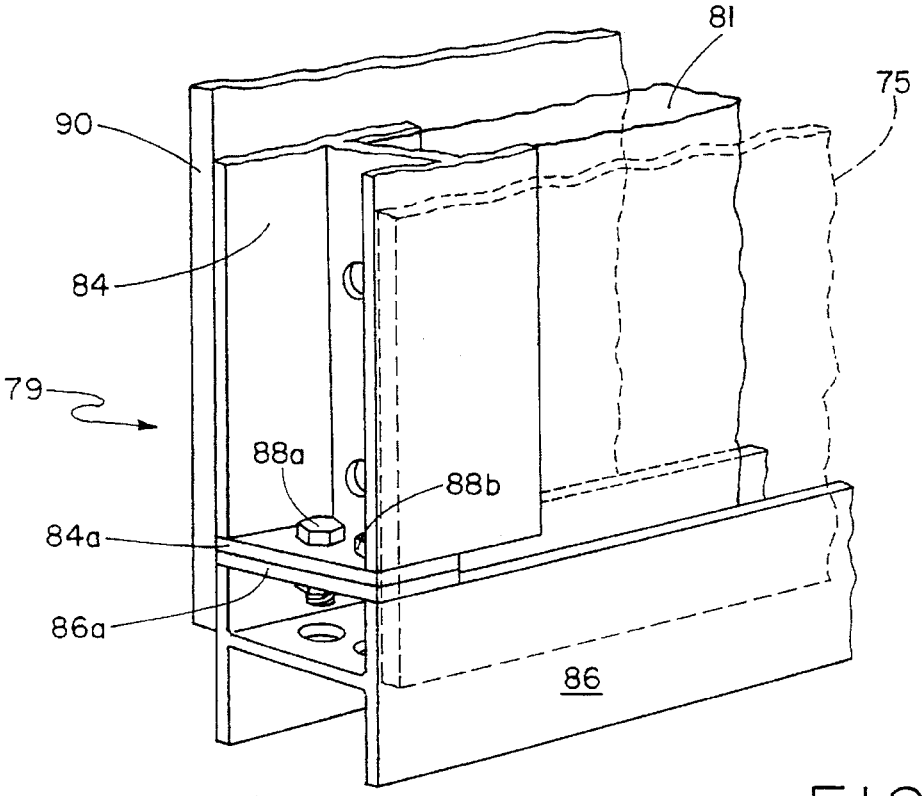
FIG. 8 is a perspective view of a corner portion of a floor panel for use in the present invention.

Referring to FIG. 8, there is shown a perspective view of a corner portion of a floor section 79 in accordance with the present invention. Floor section 79 includes four metal edges, with only two of these metal edges shown as elements 84 and 86 in the figure. Each of the metal edges 84, 86 is preferably in the form of an I-beam, with each I-beam having a plurality of apertures in spaced relation along its length for attachment to an adjacent I-beam, as well as for attaching a hinge to the metal edge as described above. Thus, respective ends of metal edges 84 and 86 are provided with respective connector plates 84*a* and 86*a*. Connector plates 84*a*, 86*a* are respectively coupled to metal edges 84 and 86 by conventional means such as weldments (not shown for simplicity). Each of the connector plates 84*a* and 86*a* includes a plurality of apertures therein for receiving nut and bolt combinations 88*a* and 88*b* for securely connecting adjacent ends of the metal edges 84 and 86. The metal edges of each of the floor sections facilitate connection of adjacent floor sections to one another, substantially increase the strength of each floor section, and protect the edges of the floor sections from impact damage. As shown in FIG. 8, the inner-facing channels of each of the I-beam shaped metal edges 84 and 86 are adapted to receive an insulating foam core 81. Insulating foam core 81 may be attached to each of the metal edges 84 and 86 by conventional means such as an adhesive or by screws inserted through apertures in the metal edges and engaging the insulating core. In addition, a structural panel 90 such as of wood is attached around its peripheral edges to the plurality of metal edges to form floor decking. A second structural panel 75 (shown in dotted line form) such as of metal may be attached to the opposing face of the floor section 79 for increased strength. The outer structural panels, which may be of wood, metal, or composite cement/gypsum, may be attached to the metal edges of the floor section 79 by conventional means such as an adhesive or screws.

Figure 9:
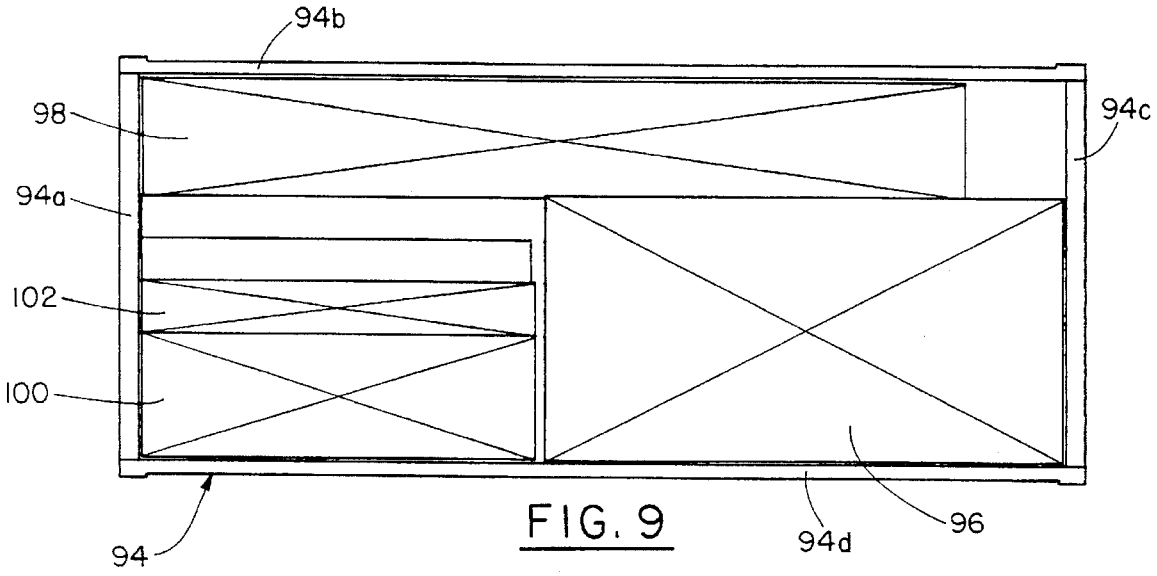
FIG. 9 is a sectional view of a closed shipping container comprised of a floor system in accordance with the present invention illustrating storage of various house components and assemblies within the closed container.

Referring to FIG. 9, there is shown a sectional view of a closed shipping container 94 comprised of a floor system in accordance with the present invention. The closed container 94 includes floor sections 94*a*–94*d* as well as end panels which are not shown in the figure for simplicity. Disposed within the closed container 94 are various house structural members such as outer wall panels 96, roof panels 98, inner wall panels 100 and doors 102. Closed container 94 provides a strong, sealed enclosure for the various house structural members which is particularly adapted for handling by conventional cargo handling equipment.

Figure 10:
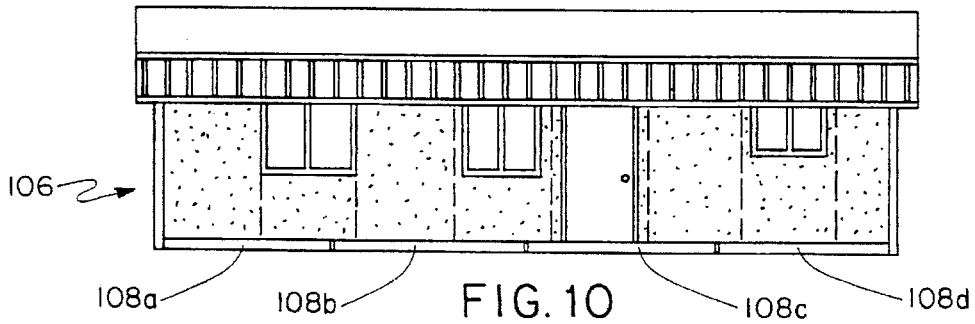
FIG. 10 is a side elevation view of a house incorporating a floor system in accordance with the present invention.
Figure 11:
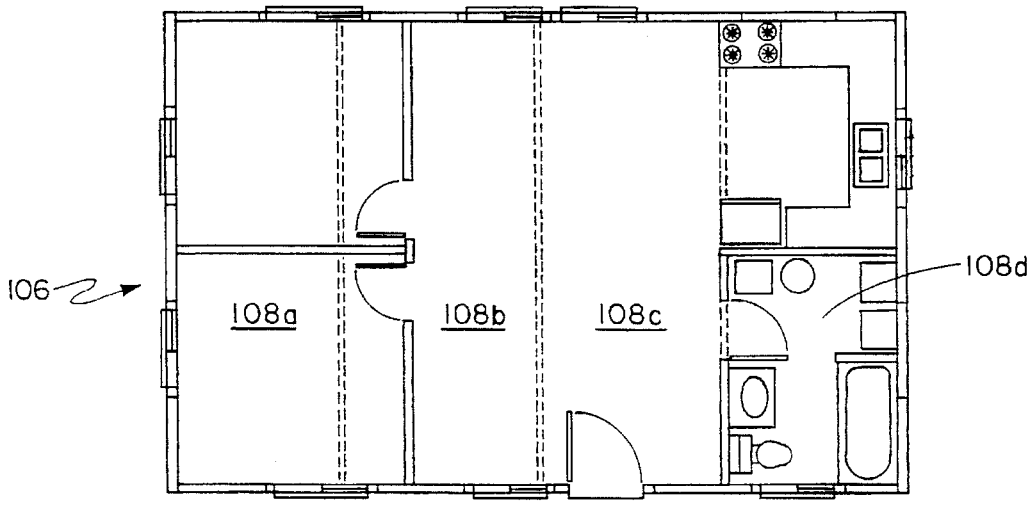
FIG. 11 is a top plan view of the house of FIG. 10 shown with the roof removed to illustrate details of the structure of the house in accordance with the principles of the present invention.

Referring to FIGS. 10 and 11, there are respectively shown side elevation and top plan views of a house 106 with the roof removed, including a plurality of hingedly coupled floor sections 108*a*–108*d* in accordance with the present invention. The hinged floor sections 108*a*–108*d* when unfolded to a generally planar configuration form the floor of house 106. Various structural members shown stored in the closed container 94 of FIG. 9. Such as inner and outer walls, the roof and doors, are shown assembled in house 106 in FIGS. 10 and 11.

There has thus been shown a building floor system such as for use in a house and a shipping container therefor. The floor system includes a plurality of hingedly coupled flat sections which can be arranged in a folded configuration to form a substantially closed container and which can also be unfolded to form a flat structure for use as a floor. With the floor sections in the folded configuration, the thus formed closed container is adapted to receive and enclose other building structures and serves as a shipping container for the entire building structure. Each flat, generally rectangular floor section includes a plurality of metal edges around the periphery thereof which increase the strength of the section and facilitate secure coupling between adjacent sections. Removable metal joining members are attached to the corners of adjacent floor sections and are disposed in the corners of the rectangular container when the panels are folded to provide a high strength container which is particularly adapted for handling by conventional shipping apparatus. Each floor section includes a structural panel or a pair of structural panels arranged in facing relation on the metal edge frame. Each corner joining member is preferably comprised of an ISO connector casting and reinforcing angle. Each floor section may also include an insulated foam core disposed between the facing outer structural panels. The folded floor container may be used to store other structural members such as walls, roofs, doors, etc., during shipping, thus substantially reducing the shipping volume as compared to a pre-assembled building and eliminating the need to fabricate and return a shipping container. The typical floor section is on the order of 20' long×8' wide×8½" thick, with four such floor sections forming a floor 20'×30'. A container formed of four such floor sections permits a house, including its various structural members, to be shipped in ¼ the space required for a pre-assembled house.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A building floor system and shipping container therefor comprising:

first and second end panels;

a plurality of rectangular, generally flat floor sections each having a peripheral metal edge portion and floor decking attached to said metal edge portion;

hinge means for pivotally coupling each floor section to one or more adjacent floor sections, wherein said floor sections may be folded to form a substantially closed container with said first and second end panels attached to opposed ends of each of said floor sections for enclosing other building structural members such as for shipping or wherein said floor sections may be unfolded to form a generally flat surface for use as a floor; and reinforcing members attached to adjacent corners of the metal edge portions of coupled floor sections when said floor sections are folded for increased strength of said closed container, wherein said reinforcing members may be removed to permit said floor sections to be unfolded to form said generally flat floor structure.

2. The building floor system and shipping container of claim 1 wherein said floor decking is attached to said metal edge portion on a first side of said floor section and is comprised of wood.

3. The building floor system and shipping container of claim 1 wherein each floor section further includes an insulating core disposed adjacent said floor decking and attached to the metal edge portion of said floor section.

4. The building floor system and shipping container of claim 3 wherein each floor section further includes a metal panel attached to said metal edge portion on a second, opposed side of said floor section.

5. The building floor system and shipping container of claim 1 wherein said metal edge portion of each floor section includes a plurality of I-beams coupled together at respective adjacent ends thereof to form a generally rectangular structure.

6. The building floor system and shipping container of claim 1 wherein each reinforcing member includes a connector housing and a reinforcing angle.

7. The building floor system and shipping container of claim 6 wherein said connector housing includes a plurality of apertures for receiving material handling apparatus and said reinforcing angle includes a plurality of C-shaped channels attached to an outer surface of said connector housing.

8. The building floor system and shipping container of claim 7 wherein each reinforcing member is comprised of metal.

9. The building floor system and shipping container of claim 7 further comprising coupled means for removably attaching each of said reinforcing members to the metal edge portions of coupled floor sections when said floor sections are folded.

10. The building floor system and shipping container of claim 9 wherein said coupling means include a plurality of nut and bolt combinations.

11. The building floor system and shipping container of claim 1 wherein said hinge means include a plurality of hinges disposed in a spaced manner along the length of adjacent floor sections and attached to the metal edge portions of said floor sections.

12. A floor section for a building for use with similar connected floor sections for forming a floor structure for the building when said floor sections are unfolded or for forming in combination with first and second end panels a substantially closed container for enclosing various structural members of said building when said floor sections are folded together, said floor section comprising:

a generally rectangular metal frame forming a peripheral edge portion of said floor section;

a plurality of hinges attached to said metal frame for pivotally coupling said floor section to a metal edge frame of one or more similar floor sections, whereby said floor sections may be folded together and connected at respective ends thereof to the first and second end panels to form said substantially closed container or unfolded to form said floor structure;

floor decking attached to a first upper side of said metal frame; and four reinforcing members each attached to a respective corner of said metal frame and coupled to a respective corner of the rectangular metal frame of another similar floor section when said floor sections are folded together for increasing the strength of the container, wherein said reinforcing members are removable from the metal frames to permit said floor sections to be unfolded to form said floor structure.

* * * * *